US005593199A

United States Patent [19]

Fandrich et al.

[11] Patent Number: 5,593,199

[45] Date of Patent: Jan. 14, 1997

[54] METHOD AND GRAPLE APPARATUS FOR GRASPING AND LIFTING BULK MATERIALS

[75] Inventors: Helmut E. Fandrich, 2461 Sunnyside Place, Abbotsford, B.C., Canada, V2T 4C4; Kelly A. Krammer, Abbotsford, Canada

[73] Assignee: Helmut Edward Fandrich, Abbotsford, Canada

[21] Appl. No.: 293,705

[22] Filed: Aug. 22, 1994

[51] Int. Cl.[6] ..... B66C 3/00

[52] U.S. Cl. ..... 294/88; 294/110.1; 294/118

[58] Field of Search ..... 294/68.23, 88, 294/106–109, 110.1, 111, 112, 118, 119

[56] References Cited

U.S. PATENT DOCUMENTS

| | | | |
|---|---|---|---|
| 52,134 | 1/1866 | Buckman et al. | 294/109 |
| 245,475 | 8/1881 | Fowler | 294/109 |
| 572,490 | 12/1896 | Lewis | 294/109 |
| 1,003,352 | 9/1911 | Gaussiran | 294/109 |
| 1,151,052 | 8/1915 | Sales | 294/109 |
| 2,381,045 | 8/1945 | Gammel | 294/110.1 |
| 2,959,444 | 11/1960 | Callender | 294/88 |
| 4,396,215 | 8/1983 | McCutcheon | 294/88 |
| 4,783,106 | 11/1988 | Nutter | 294/88 |

FOREIGN PATENT DOCUMENTS

| | | | |
|---|---|---|---|
| 244272 | 4/1987 | Germany | 294/68.23 |
| 52-69149 | 6/1977 | Japan | 294/110.1 |
| 627807 | 8/1949 | United Kingdom | 294/110.1 |

*Primary Examiner*—Dean Kramer
*Attorney, Agent, or Firm*—William S. Lovell

[57] ABSTRACT

A grapple particularly adapted for use with a helicopter is able to control heavy loads and to latch onto such loads, or release the same, by remote control from the helicopter. Shock absorbing features serve to minimize the effects of such loads on helicopter operation. The weight of the arms and frame in one embodiment provide the necessary latching action, while in other embodiments the latching system is operated hydraulically, either separately as to each arm/frame pairs or by use of a single hydraulic control for both arm/frame pairs. A hydraulic pressure sensitive device is provided to adapt the amount of shock absorption to the magnitude of the load. Spring assistance to the load-grasping process is also incorporated into the device.

6 Claims, 6 Drawing Sheets

METHOD AND GRAPLE APPARATUS FOR GRASPING AND LIFTING BULK MATERIALS

FIELD OF THE INVENTION

The invention relates generally to methods and apparatus for grasping and lifting bulk materials, and particularly to methods and apparatus for carrying out logging and related operations, e.g., in picking up, carrying and dumping logs, and also debris left behind after completion of a forest harvesting operation.

DESCRIPTION OF THE PRIOR ART

Lifting or hoisting various materials or articles through the use of hooks and grapples is an old art. For example, U.S. Pat. No. 1,151,052 issued Aug. 24, 1915 to Sales describes a structure adapted for handling hay and having a pair of opposing curved levers that are rotatably mounted to a frame descending from a derrick, and then rotatably attached to the respective levers is a pair of similarly opposing curved forks that are used to grasp a material, e.g., hay. The forks are normally latched to the levers so as to permit grasping a load, and by virtue of a set of pulleys and cables will close-together whenever the structure is lifted from the ground. An additional force provided by a separate cable is then required to unlatch the forks so as to release a load.

U.S. Pat. No. 1,003,359 issued Mar. 2, 1911 to Gaussiran describes a grapple comprising a plurality of arm pairs, mutually rotatably attached in a spaced-apart relationship along a single pivot axis and having a straight upper portion and an inwardly-facing hooked portion, those hooked portions on each pair of said arms being disposed on opposite sides of said pivot axis and facing inwardly therein. The upper portions of the arms on each side of the rotational axis are fixedly interconnected by a top bar, so that all of the arms on each separate side of the rotation axis will rotate together. Rotational motion of each assembly of arms on each side is controlled by a pair of bars rotatably attached part way down the lower portion of the two central arms, on opposite sides of the rotation axis, and at the upper end thereof, after said bars have mutually crossed over, to a corresponding pair of pulleys. Coaxial with the axis of each pulley there is rotationally mounted a latch that is disposed to engage the facing one of said top bars when the grapple is in a closed position. Release of those latches, and hence dropping of a load, is accomplished by pulling on a rope which in turn is attached to a hook that is then moved under the latch bar so as to release the top bar and allow the arms to swing apart.

U.S. Pat. No. 572,490 issued Dec. 1, 1896 to Lewis describes a hay fork comprising a pair of mutually facing hooks rotatably attached to a single frame to which is attached a lifting ring at the top and a pulley-and-rope assembly from which ropes attach to a latch on each hook structure. Upon having grasped a load and transported it as desired, a downward force on a central rope disconnects each latch so that the weight of the load causes the same to be released.

U.S. Pat. No. 52,134 issued Jan. 23, 1866 to Buckman et al. describes a hay-fork apparatus in which a pair of facing arms, as well as a pair of upper frames, are together rotatably interconnected at a single pivot point. A fork extension is rotatably attached near the lower end of each such arm, such that inward motion of the arms is transformed in an even greater inward motion of the arm extensions, thus producing a "hooking" effect that reaches under a load. Each of the aforesaid upper frames has rotatably attached thereto a bar that is attached both rotatably and slot-wise to an upward and outward extension of each arm to serve as a guide. Ropes are attached to the upper ends of the upper extensions of the arms, and because of their outward disposition, a downward pull on such ropes, coupled with the lever action at the pivot point, causes those extensions to move downward and yet further outward, which in turn spreads apart the arms proper to drop a load.

Other forks or grapples such as those used to harvest logs similarly require some external force, such as that produced by a hydraulic cylinder, to close and open the arms or forks when desired.

For greater ease of operation, and particularly when using a grapple that is extended downward from a helicopter wherein (1) the weight of the lifting device becomes more critical; and (2) it becomes important to avoid shocks being transmitted upwardly along such a line that might destabilize the flight operations of the helicopter, it would then be useful to provide a method and apparatus for such grasping, lifting and releasing operations in which opening and closing of the forks of a grapple occurred smoothly and automatically.

It is thus a principal object of the present invention to provide means for the placement of the forks of a grapple under a log or pile of debris so as to grasp the same, for the lifting of that log or pile, and then the release or dumping of such a load in a manner that will not impart a sudden shock to the operation of a helicopter from which the grapple has been lowered. It is a further object of the invention to provide means for automatic resetting of such a grapple for a second load and the like after such a first load has been released, and specifically through means which require no additional source of mechanical power other than the lifting operation of the helicopter itself.

SUMMARY OF THE INVENTION

The invention comprises a grapple having on each half thereof an arm that is rotatably connected to the arm of the other half, a frame pivoting on each arm, a latching means also holding an opposite end of the frame to each arm, and cables connecting the frame to a lifting device. In transporting a load, the latches hold the frame up against the arms. To release a load, a helicopter pilot triggers the latches so as to release the top end of the frame from the arms while the bottom end of the frame remains fastened to the arms. The force of the cables, through the frames, pulls the arms apart so that the load is released and falls away.

The grapple is lowered to the ground with the arms apart so as to wrap around a new load, and with the cables slack the frame is pulled downward by its own weight until the latch on the arm engages the frame. The pilot then lifts the cables so that the force of the cables on the frame pulls the arms together to grasp the load. Continued lifting tightens the arms about the load so that the same may then be transported, until the pilot again triggers the latches so as to open the latches and dump the load.

GENERAL DESCRIPTION OF THE DRAWINGS

The invention is illustrated by way of example in the following drawings in which.

DETAILED DESCRIPTION OF THE INVENTION

Figure 1A:
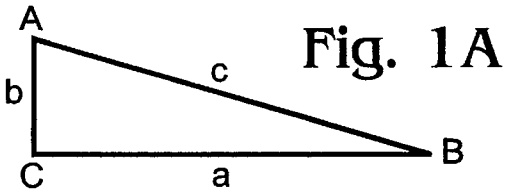
FIGS. 1A and 1B show two right triangles with sides and angles defined in a conventional manner for reference.
Figure 1B:
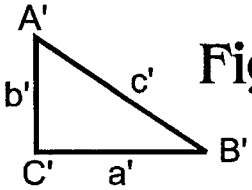

FIGS. 1A and 1B show a standard method of defining sides and angles of a set of two right triangles, which are intended to establish the meanings of the reference letters when used in connection with the different frames that are a part of the invention. FIG. 1A shows a relatively elongate right triangle having sides defined as a=horizontal side; b=vertical side; and c=hypotenuse, with angles defined as A lying between b and c; B lying between a and c; and C lying between a and b. FIG. 1B shows a shorter right triangle having sides defined in a like manner as a'=horizontal side; b'=vertical side; and c'=hypotenuse, with angles similarly defined as A' lying between b' and c'; B' lying between a' and c'; and C' lying between a' and b'. Similar references are used in designating corresponding parts of the frames of the invention.

Figure 2D:
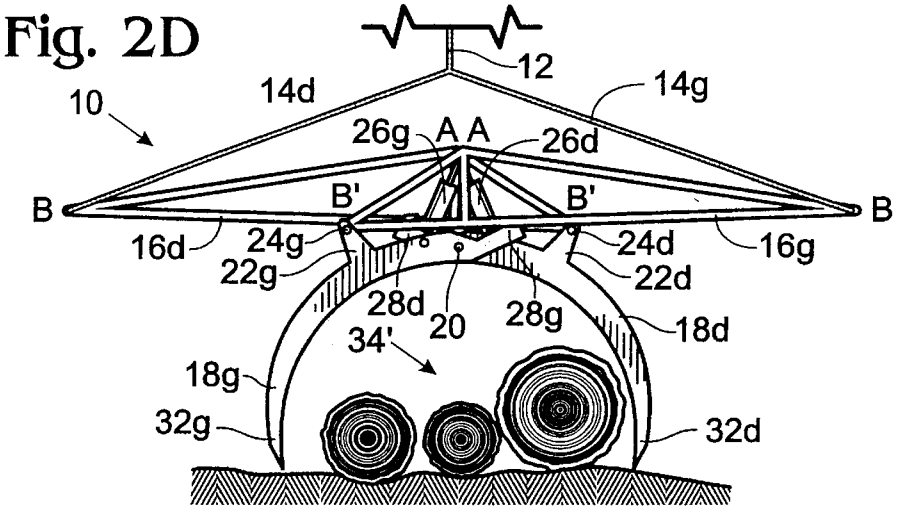
FIG. 2D shows in front elevation a fourth configuration of the grapple of FIG. 2A in which the cables are fully slack and the frames have collapsed so as to re-set the latches preparatory to grasping the new load.
Figure 2C:
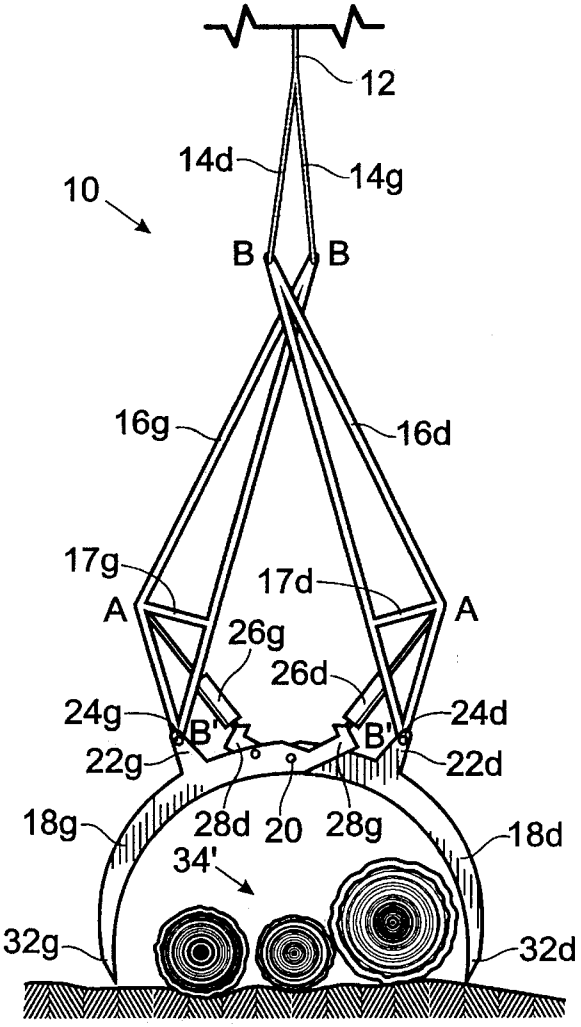
FIG. 2C shows in front elevation a third configuration of the grapple of FIG. 2A in which the two arms have fully rotated about an arm pivot so as to become entirely open to permit being wrapped around a new load.
Figure 2E:
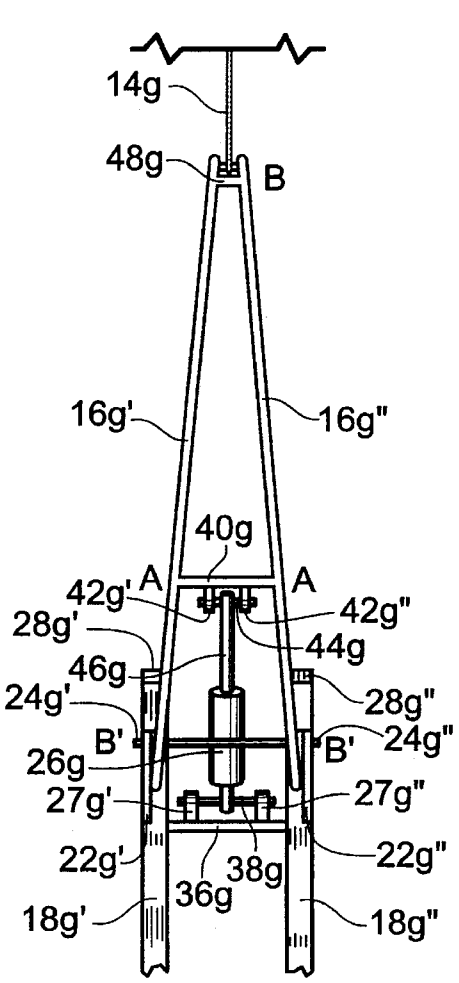
FIG. 2E shows a side elevation view of a portion of the grapple of FIGS. 2A–2E, including one form of arm and frame structure.
Figure 2B:
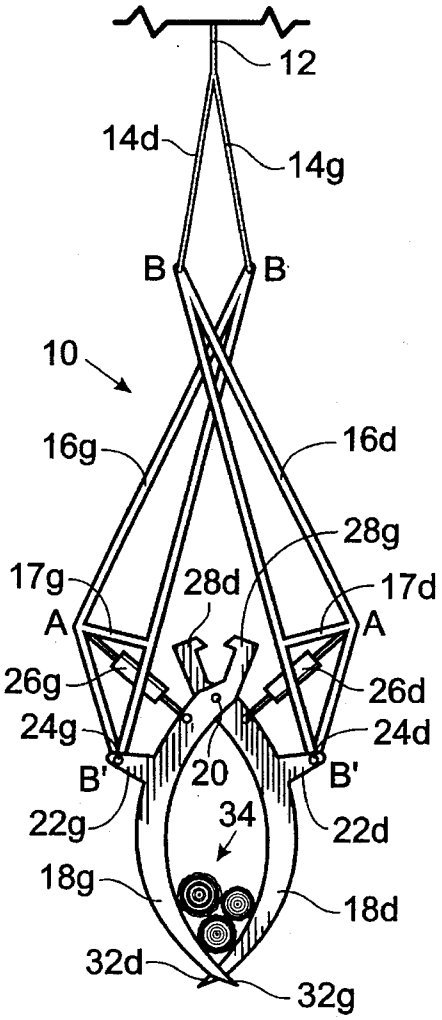
FIG. 2B shows in front elevation a second configuration of the grapple of FIG. 2A in which the two frame latches have been released so as to permit the load to fall by its own weight.
Figure 2A:
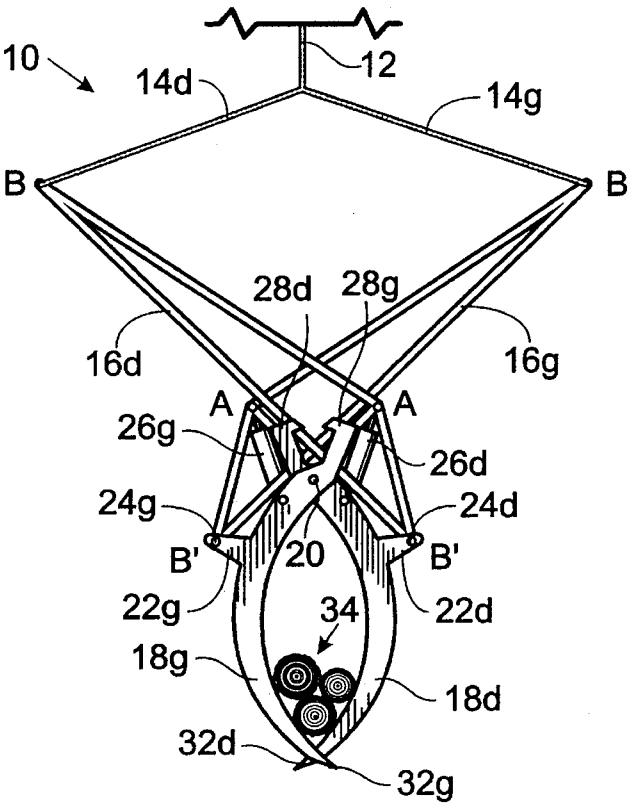
FIG. 2A shows in front elevation a first configuration of an embodiment of the invention in which two grapple arms are closed about a load.

FIG. 2A shows a front elevation view of an embodiment of a grapple 10 at a stage of operation thereof in which a load is being carried. Descending from a height, e.g., as from a helicopter (not shown), a cable 12 separates into two branches, 14*g* (i.e., g=gauche or left) and 14d (i.e., d=droit or right), each of which then respectively connect to a left frame 16*g* and a right frame 16*d*. Frames 16*g*, 16*d* have a structure equivalent to that formed by the combination of two right triangles, e.g., a relatively long triangle as shown in FIG. 1A, and a shorter triangle as shown in FIG. 1B, in such manner that the respective vertical sides of the two triangles (i.e., b and b' in FIGS. 1A, 1B) coincide to define a single bracing member 17*g* or 17*d*, whereas the horizontal sides (i.e., a and a' in FIGS. 1A, 1B) are collinear. Of course, left and right frames 16*g*, 16*d* may optionally have further bracing members in addition to respective bracing members 17*g* and 17*d*.

With reference to FIGS. 1A, 1B, the points of interest on the frames of FIG. 2A (and thereafter) can be referred to such that the narrowest angle of the elongate triangle (i.e., B in FIG. 1A) is likewise designated as B in FIG. 2A (and thereafter); the narrowest angle of the shorter triangle (i.e., B' in FIG. 1B) is likewise designated as B' in FIG. 2A (and thereafter); and the juncture of the two hypotenuses (i.e., c and c' of FIGS. 1A, 1B) at the common point A, A' can simply be designated for brevity as point A in FIG. 2A (and thereafter). The two cable branches 14*g*, 14*d* thus connect to left and right frames 16*g*, 16*d* at the respective points B thereof.

Grapple 10 further comprises left and right arms 18*g*, 18*d* that are rotatably interconnected at arm pivot 20, which is itself disposed a short distance from a first end of left and right arms 18*g*, 18*d*. (This structure is distinguishable from that of Sales in which the analogous arms thereof (called "forks") are not directly interconnected, there being instead a rotatable interconnection between the levers to which those forks are attached.) Left and right arms 18*g*, 18*d* comprise curved, elongate structures approximately in the form of the letter "c" and are disposed with the concave portions thereof mutually facing. Approximately ¼ of the distance from arm pivot 20 along the respective lengths of left and right arms 18*g*, 18*d*, each of left and right arms 18*g*, 18*d* further comprise pivot extensions 22*g*, 22*d*, each in the form of a flat, approximately triangular member that protrudes outwardly from the convex sides of left and right arms 18*g*, 18*d*. Points B' of left and right frames 16*g*, 16*d* are respectively rotatably attached to left and right frame pivots 24*g*, 24*d*, which are respectively located near to the distal ends of pivot extensions 22*g*, 22*d*.

In addition, left and right shock absorbers 26*g*, 26*d* are respectively rotatably attached to corresponding left and right arms 18*g*, 18*d* at respective left and right shock absorber pivots 27*g*, 27*d* thereon that are approximately ⅓ of the distance along left and right arms 18*g*, 18*d* from arm pivot 20 to the corresponding ones of pivot extensions 22*g*, 22*d*. In each case, the opposite or distal ends of left and right shock absorbers 26*g*, 26*d* are respectively rotatably connected to points A of left and right frames 16*g*, 16*d*. The nature of and means of operation of left and right shock absorbers 26*g*, 26*d*, which also may be placed into shortened and extended configurations, will be described further below.

Each of left and right arms 18*g*, 18*d* further comprise respective left and right hooks 28*g* at the aforesaid first ends of corresponding left and right arms 18*g*, 18*d*. Second or distal ends 32*g*, 32*d* of left and right arms 18*g*, 18*d* are disposed oppositely thereon from respective first ends thereof.

The operation of grapple 10 will now be described with reference to FIGS. 2A–2D. In FIG. 2A, it can be seen that points B of left and right frames 16*g*, 16*d* are widely separated. Inasmuch as left and right shock absorbers 26*g*, 26*d* are in a shortened configuration (by virtue of latches that will be described below), however, points A of left and right frames 16g, 16d are held closely together, as are also points B' of left and right frames 16g, 16d. In such a configuration of grapple 10, left and right arms 18g, 18d are constrained into close proximity such that distal ends 32g, 32d of left and right arms 18g, 18d have overlapped, i.e., in the perspective of FIG. 2A left distal end 32g lies to the right of right distal end 32d, thereby effecting closure of left and right arms 18g, 18d so that a load 34 will be held therebetween.

In FIG. 2B, left and right shock absorbers 26g, 26d have attained an extended configuration, permitting left and right frames 16g, 16d to rotate respectively about left and right frame pivots 24g, 24d, so that points B of left and right frames 16g, 16d move closer together and give grapple 10 a more elongate configuration. Once that configuration is reached, the weight of load 34 begins to force left and right arms 18g, 18d apart, causing relative rotation one to the other at arm pivot 20 as well as continued rotation of left and right frames 16g, 16d at left and right frame pivots 24g, 24d. The rotation of left and right arms 18g, 18d at arm pivot 20 also forces pivot extensions 22g, 22d and hence points B' of left and right flames 16g, 16d to move apart until the configuration shown in FIG. 2C is reached and the load is fully released.

At this point, grapple 10 is lowered to the ground at a position at which another load 34' can be grasped, as shown in FIG. 2D. Cables 12 and 14g, 14d are allowed to go slack, as a result of which left and right frames 16g, 16d fall into the fully collapsed position shown in FIG. 2D, i.e., both pairs of points B and points B' of left and right frames 16g, 16d achieve a maximum separation one to the other of each pair. The weights of left and right frames 16g, 16d are respectively transmitted at points A thereof to left and right shock absorbers 26g, 26d so as to force the same into the shortened configuration of FIG. 2D; appropriate latches are engaged as will be described below; and finally, lifting of cables 12 and 14g, 14d then places grapple 10 as a whole back into the configuration shown in FIG. 2A, except that it is now the new load 34' that is being held. In that final step, it can be seen that with left and right shock absorbers 26g, 26d being shortened, rotation of left and right frames 16g, 16d about points B' thereof so as to achieve the more elongate configuration of FIG. 2A also forces inward rotation of left and right arms 18g, 18d about arm pivot 20, whereby new load 34' is grasped as just stated.

FIG. 2E shows in side elevation view a portion of one side (e.g., the left or "gauche" side) of the grapple of FIGS. 2A–2D, including one form of an arm and frame structure. In this side view, it can be seen that grapple frame 16g may consist of first and second converging members 16g' and 16g", and similarly grapple arm 18g may consist first and second parallel members or "tines" 18g' and 18g", which in each case are respectively interconnected by struts. This structure is particularly convenient for the mounting of piston-like shock absorber 26g. In the greater detail of FIG. 2E, left shock absorber pivot 27g is seen to be formed by first mount pair 27g' and 27g", which are fixedly attached to first strut 36g which is itself connected between tines 18g' and 18g" of left arm 18g (and similarly in this and the subsequent description, of course, as to the right side of grapple 10). First axle 38g is rotatably affixed between first mount pair 27g' and 27g". Left shock absorber 16g is then attached to first axle 38g and can be rotated about the axis thereof into such positions as are shown in FIGS. 2A–2D. (The term "strut" is used here and in what follows to designate a member that is fixedly attached between two other members, while the term "axle" is likewise used to designate a member that either has other members rotatably attached to it or is itself rotatably attached between two members.)

Left frame pivot 24g is seen in FIG. 2E to be a single structure, i.e., to consist of a second axle extended between first and second tines 18g' and 18g' of left arm 18g and having opposite ends 24g' and 24g". Near each of opposite ends 24g' and 24g" first and second converging members 16g' and 16g" are respectively rotatably attached, at points B' of the latter.

Second strut 40g is fixedly attached between first and second converging members 16g' and 16g" at points A thereof and provides means for connection to the distal end of left shock absorber 26g. That is, second mount pair 42g' and 42g" is fixedly attached to second strut 40g; third axle 44g extends rotatably between second mount pair 42g' and 42g', and axial member 46g fixedly attaches at a proximal end thereof to the center of third axle 44g and, in a moveable fashion, at the distal end thereof to shock absorber 26g. As will be described more fully below, it is an effectively varying length of axial member 46g that represents variation in the distance between left shock absorber pivot 27g and point A of left arm 16g, which (upon taking account of like action in the right half of grapple 10) allows grapple 10 to assume the several configurations of FIGS. 2A–2D.

FIGS. 3A–3D now show one mechanical embodiment of a latch, which for convenience is described here again in terms only of the left half of grapple 10. Included in each of FIGS. 3A–3D is a portion of an arm (e.g., of left arm 18g), a pivot extension (e.g., pivot extension 22g), a frame pivot (e.g., frame pivot 24g), and that portion of a frame (e.g., left frame 16g) which includes rotatable attachment of point B' of the same to frame pivot 24g. In the embodiment of FIGS. 3A–3D, latch 50g includes a hook-like lever retainer 51g fixedly attached to that side of left frame 16g which faces left arm 18g, said lever retainer 51g further including a depression 52g which faces towards pivot extension 22g.

Latch 50g further comprises latch pivot 54g attached to the side of left arm 18g that faces left frame 16g, at a position immediately adjacent lever retainer 51g. Latch hook 56g, which is a C-shaped structure having an upper hook 58g and a lower hook 60g, is rotatably attached to latch pivot 54g at lower hook 60g such that upper hook 58g is rotatable into depression 52g of lever retainer 51g. Extending outwardly from the "back" side of the C opposite upper and lower hooks 58g, 60g is a rod-like latch lever 62g, on the distal end of which (away from opposite upper and lower hooks 58g, 60g) is transversely fixed a latch hammer 64g. Adjacent latch hammer 64g, but attached to the side of left arm 18g that faces left frame 16g, is a solenoid 66g having solenoid extension 68g disposed in such manner as to contact a lower end of latch hammer 64g and hold the same in place.

Figure 3A:
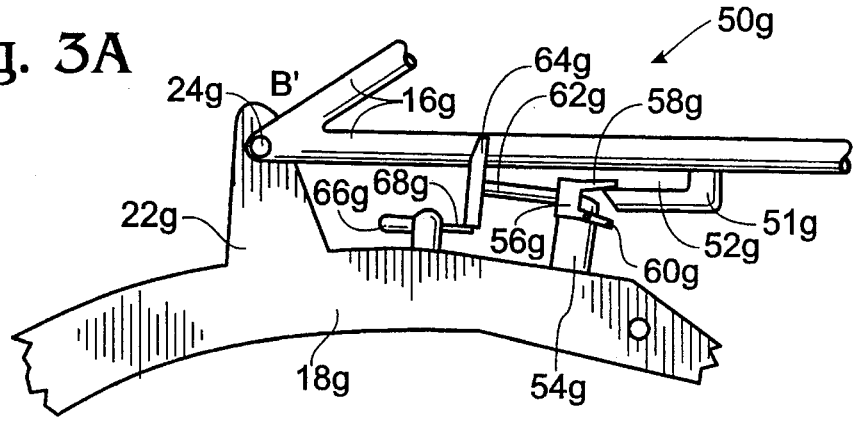
FIGS. 3A–3D show in side elevation four views of a latch mechanism operated by a solenoid, each in a different, sequential configuration.
Figure 3B:
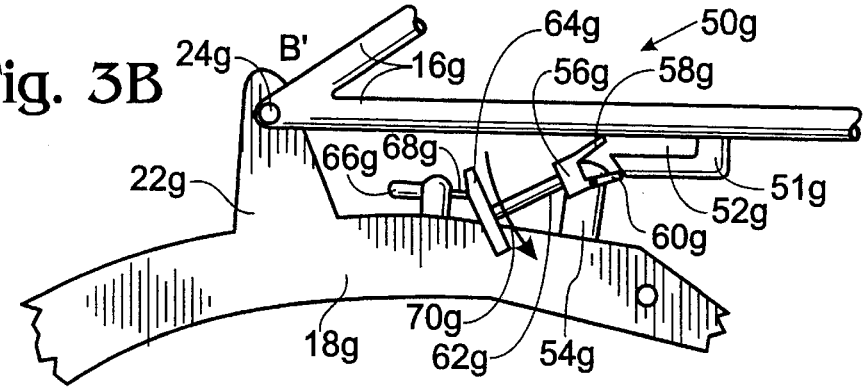
Figure 3C:
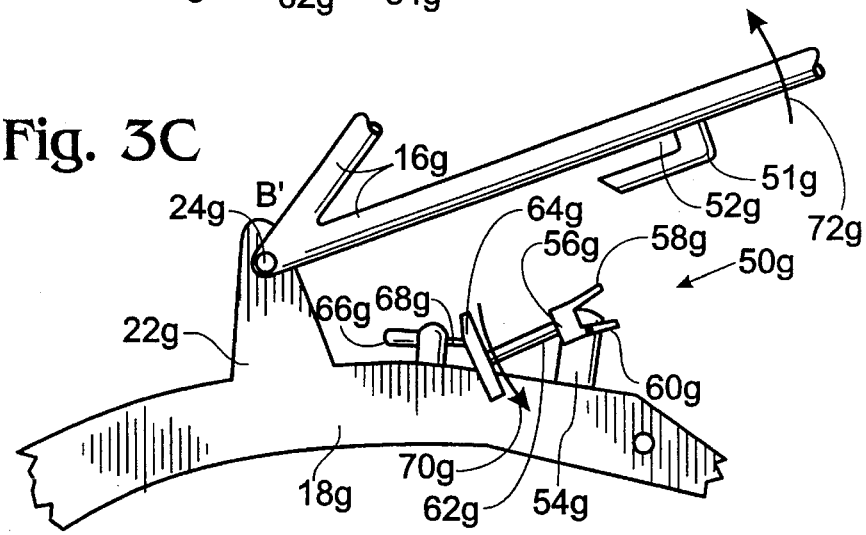
Figure 3D:
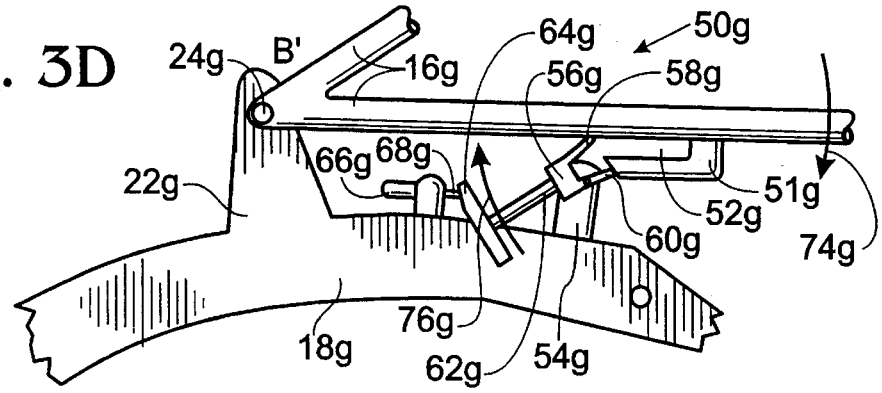

In the aforesaid configuration, upper hook 58g of latch hook 56g is disposed within depression 52g of lever retainer 51g so as to hold left frame 16g in near proximity to left arm 18g. As shown in FIG. 3B, however, activation of solenoid 66g by an electrical signal from a helicopter (electrical lines not shown) causes retraction theretowards of solenoid extension 68g so as no longer to be in contact with the lower end of latch hammer 64g, thereby permitting the same to fall downward, which in turn causes rotation of latch lever 62g about latch pivot 54g in the direction of arrow 70g. Consequently, as shown in FIG. 3C, upper hook 58g is thereby disengaged from depression 52g so that left frame 16g is permitted to rotate away from left arm 18g in the direction of arrow 72g.

Finally, upon providing slack to cables 12 and 14*g*, 14*d* so that grapple 10 collapses into the configuration of FIG. 2D previously described, the weight of left frame 16*g* moves the same downwardly in the direction of arrow 74*g*, which forces lever retainer 51*g* down against lower hook 60*g* (said point of contact being shown in FIG. 3D as point "x") to cause rotation of latch lever 62*g* about latch pivot 54*g* in the direction of arrow 76*g*. Such rotation continues until the point at which latch hammer 64*g* is again disposed above solenoid extension 68*g*, whereupon the latter springs out again from solenoid 66*g* so as again to achieve the configuration shown in FIG. 3A. Latch hammer 64*g* is preferably relatively weighty, and will also have a partially curved surface facing solenoid extension 68*g* so as to drop past the latter upon retraction of the same, but yet to pass smoothly back in the direction of arrow 76*g* upon the weight of latch hammer 64*g* being overcome by the greater weight of left frame 16*g* as just described. The aforesaid operation of left latch 50*g* (and similarly, of course, as to a right latch 50*d*) in the embodiment described with reference to FIGS. 3A–3D thus accounts for the operation of grapple 10 as a whole as was described earlier with reference to FIGS. 2A–2E.

Figure 4B:
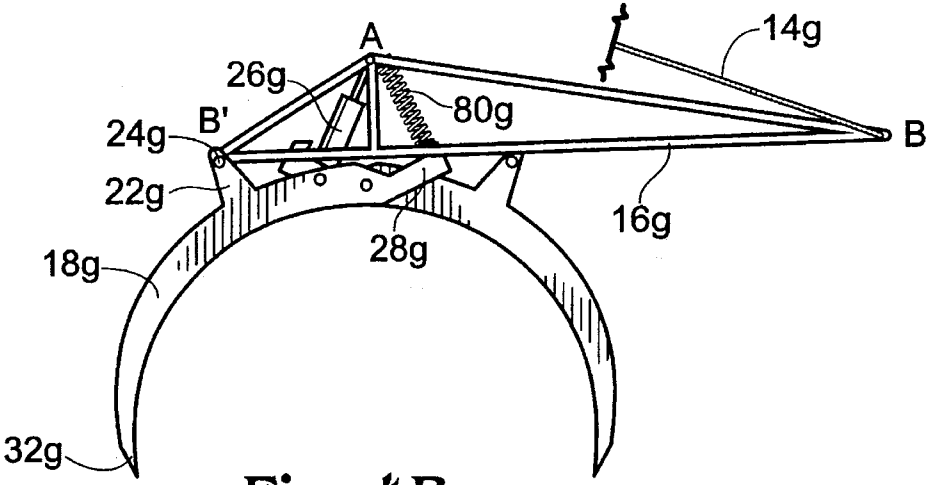
FIGS. 4A–4B show in side elevation two different configurations of a spring system to aid in operation of the grapple of FIGS. 2A–2D.
Figure 4C:
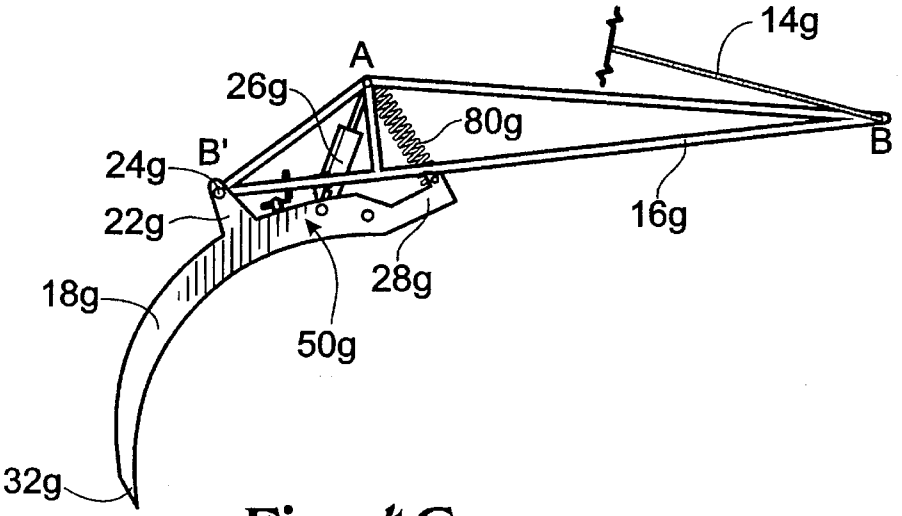
FIG. 4C shows in schematic form an embodiment of the grapple that includes both the latch mechanism of FIGS. 3A–3D and the spring of FIGS. 4A–4B.
Figure 4A:
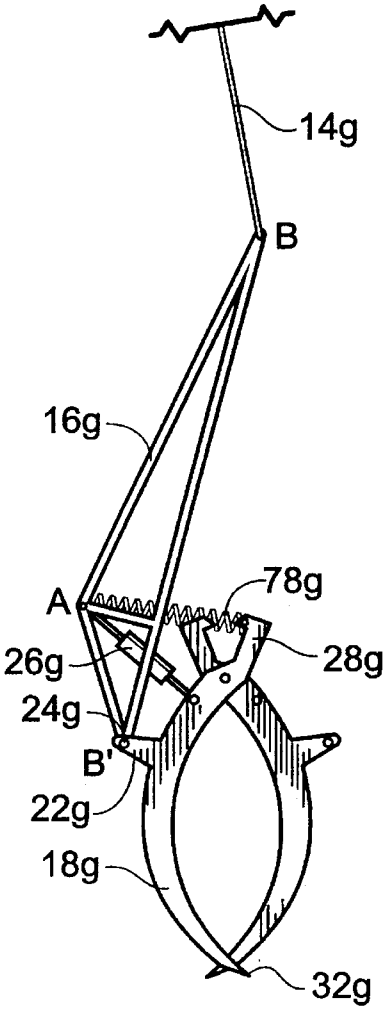

FIGS. 4A–4B show a spring mechanism for assisting in the aforesaid operation. Again with reference to just the left half of grapple 10, FIG. 4A is a variation of FIG. 2B with right frame 16*d*, shock absorber 26*d* and the notation for the right hand side thereof deleted for clarity, and showing a first left spring 78*g* connected on one end thereof to left hook 28*g* and on the other end to left frame 16*g* at a point on hypotenuse c' approximately ¼ the distance from point A to point B'. Similarly, FIG. 4B is an adaptation of FIG. 2D having the like elements (along with load 34') deleted therefrom, and showing a second left spring 80*g* connected to left hook 28*g* as before, but with the opposite end thereof connected to point A of left frame 16*g*. Either of first or second left springs 78*g*, 80*g* serve to provide a force additional to that of the weight of left frame 16*g* alone to the process of changing the configuration of grapple 10 from that shown in FIG. 2B to that shown in FIG. 2D. One or the other of left springs 78*g*, 80*g* thus works in conjunction with left shock absorber 26*g* to "open up" grapple 10 for the acceptance of a new load, i.e., first by the relative rotation of left and right arms 18*g*, 18*d* as shown in the transition from FIG. 2B to FIG. 2C (that actually causes dropping of a load), and second by the downward collapsing of left and right frames 16*g*, 16*d* shown in the transition from FIG. 2C to FIG. 2D (that resets the latches as described in connection with FIGS. 3A–3D). Again, left-shock absorber 26*g* ensures that while the opening up of grapple 10 to drop a load or reset its latches will take place forcefully, that process will minimize the shock to the cable reaching upward to a helicopter, a load may be dropped out bit by bit, and the decreasing load on the helicopter brought about when left and right arm ends 32*g*, 32*d* touch the ground so that left and right frames 16*g*, 16*d* collapse downwardly will occur gradually.

FIG. 4C shows in schematic form an embodiment of the grapple that includes both latch 50*g* of FIGS. 3A–3D and spring 80*g* of FIGS. 4A–4B, for which the reference numbers throughout those several figures are the same for like elements.

Figure 5C:
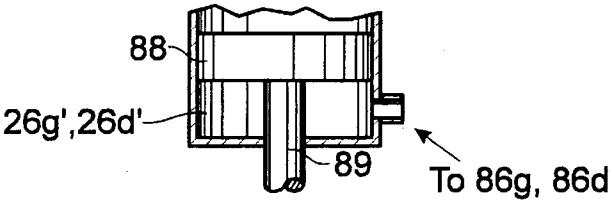
FIG. 5C shows a cutaway view of the cylinder-piston part of the shock absorber/latch of FIG. 5B.

In another embodiment of the invention, a single, self contained device serves as both shock absorber and latch. One example of this embodiment is shown in FIG. 5A, which is an adaptation of FIG. 2A and contains not a pair of simple shock absorbers, but rather hydraulically operated devices, i.e., left shock/latch 82*g* connected between point A of left frame 16*g* and a position along left arm 18*g* between arm pivot 20 and left pivot extension 22*g*, and right shock/latch 82*d* connected between point A of right frame 16*d* and a position along right arm 18*d* between arm pivot 20 and right pivot extension 22*d*, that serve both as a shock absorber and a latch. The principle of operation of such a device, as will be explained further below, rests upon the fact that motion of a fluid through an orifice can be restricted so as to slow the occurrence of events that depend upon such fluid flow; and secondly, blocking the flow of such fluid entirely has the effect of locking the device into its then-existing condition, i.e., "latching" it.

Figure 5B:
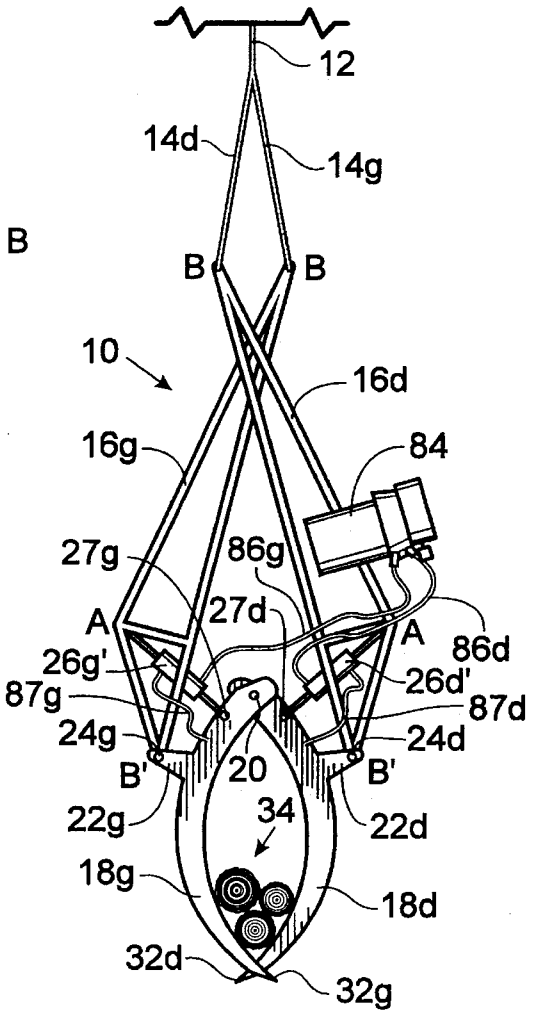
FIGS. 5A–5B show different aspects of a preferred embodiment of the invention in which a single hydraulic device serves both as a shock absorber and a latch.
Figure 5A:
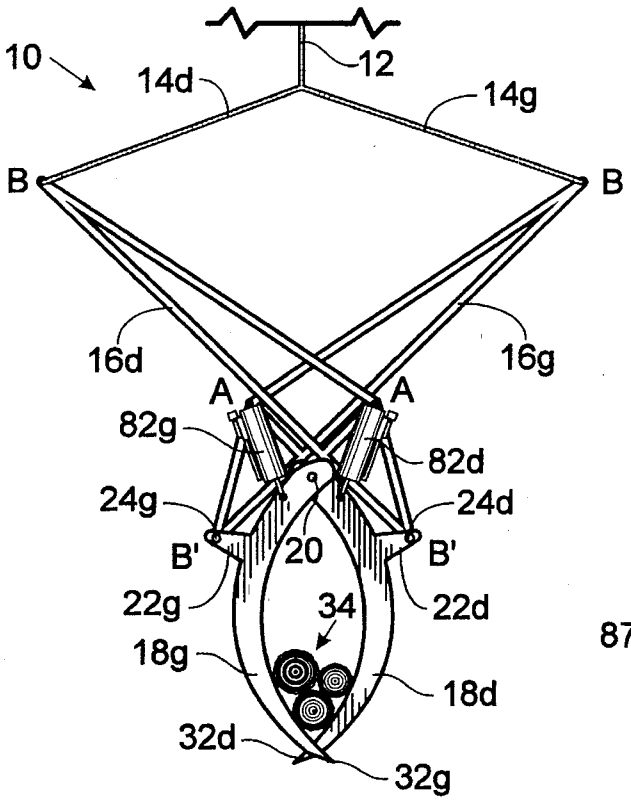

Another variation of the aforesaid embodiment is shown in FIG. 5B, in which left hydraulic shock absorber 26*g*' connects between point A of left frame 16*g* and left shock absorber pivot 27*g*, and right hydraulic shock absorber 26*d*' connects between point A of right frame 16*d* and right shock absorber pivot 27*d*, wherein the primed designations of shock absorbers 26*g*', 26*d*' designate them as being of a type adapted to accept external hoses for hydraulic control, as distinguished from shock absorbers 26*g*, 26*d* of FIG. 2A which are not so adapted. As will be seen below, shock absorbers 26*g*, 26*d* also include check valves that participate in the latching process, and these are not necessary in hydraulic shock absorbers 26*g*', 26*d*' since that latching process is carried out externally.

As is also shown in FIG. 5B, a single hydraulic control 84 is mounted on right arm 16*d*, although that mounting and the resulting connections now to be described could of course be reversed to originate on the left side just as well. Left hydraulic hose 86*g* connects from hydraulic control 84 to near the lower end of left hydraulic shock absorber 26*g*', and right hydraulic hose 86*d* connects from hydraulic control 84 to near the lower end of right hydraulic shock absorber 26*d*', both such connections to left and right hydraulic shock absorbers 26*g*', 26*d* being at the "piston" end rather than the "closed" end as will be described below.

Also, when using a hydraulic system that passes fluid into and out of some container, there must be provided a volume of space that the air of the container can be injected into or withdrawn from in accordance with the movement of that hydraulic fluid. An air valve to the open atmosphere can be used for that purpose, but such a process will expose the hydraulic fluid to the atmosphere as well. Since air is relatively compressible (as compared to hydraulic fluid), however, an enclosed container of some appreciable volume can be used for the same purpose. Thus, as to left and right hydraulic shock absorbers 26*g*', 26*d*, there are also provided left air hose 87*g* and right air hose 87*d*, which are connected between left shock absorber 26*g*' and left arm 18*g* in the former case, and right shock absorber 26*d*' and right arm 18*d* in the latter, left and right arms 18*g* and 18*d* being made hollow and airtight for that purpose, i.e., to serve as a "source" or "sink" of air when operating left and right hydraulic shock absorbers 26*g*', 26*d*'. The advantage provided by such an arrangement is that hydraulic fluid is not exposed to the open atmosphere to contaminate the same.

As shown in greater detail in FIG. 5C, connection of left and right hydraulic hoses 86*g*, 86*d* to left and right hydraulic shock absorbers 26*g*', 26*d*', respectively, are in each case made between one end thereof and a nearby piston 88 contained within each of left and right hydraulic shock absorbers 26*g*', 26*d*', said piston 88 having an associated rod 89 attached thereto and descending outwardly therefrom. Movement of piston 88 within either of left and right hydraulic shock absorbers 26*g*', 26*d*' is thus positively controlled by the capability or not of hydraulic fluid movement through left and right hydraulic hoses 86*g*, 86*d*, as will be described below.

Figure 6:
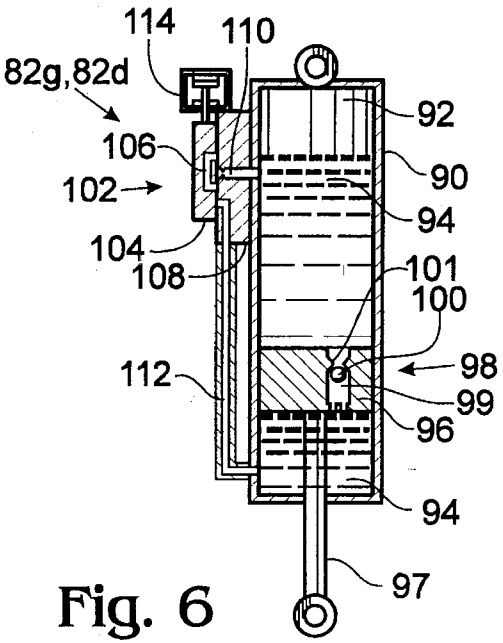
FIG. 6 shows the shock absorber/latch of FIG. 5A in greater detail.

Left and right shock absorber/latches 82*g*, 82*d* of FIG. 5A are shown in greater detail in FIG. 6 (in the numbering of which the g, d distinction is not used). This device comprises a cylinder 90 that has an internal air space 92 at the top thereof and a quantity of hydraulic fluid 94 therebelow. Within hydraulic fluid 94 there is a moveable piston 96 with attached rod 97, such that the position of piston 96 within fluid 94 determines what portion of the length of rod 97 extends outwardly from cylinder 90, i.e., in conjunction with the movement, on each side, of left and right frames 16*g*, 16*d* and left and right arms 18*g*, 18*d* of grapple 10 one to the other. The direction in which such movement can be carried out is limited by the action of check valve 98, which establishes a single direction through piston 96 in which hydraulic fluid 94 can flow therethrough.

Specifically, within piston 96 there is disposed a check valve 98, consisting of a tube 99 which passes therethrough, a ball 100, and a constriction 101. In the event of upward movement of piston 96 relative to cylinder 90 (such that left or right shock absorber/latch 82*g*, 82*d* becomes foreshortened) ball 100 is forced downwardly and hydraulic fluid 94 will flow therearound so as to permit such upward movement of piston 96, such movement being slowed by the need for the hydraulic fluid to flow through check valve 98. In the event of a force directed at downward movement of piston 96 (such that left or right shock absorber/latch 82*g*, 82*d* becomes lengthened), however, ball 100 is forced upwardly into constriction 101 within tube 99 so that hydraulic fluid cannot pass therearound, and such downward movement of piston 96 is then prevented.

Control of left and right shock absorber/latches 82*g*, 82*d* is provided by hydraulic valve 102, which includes sliding valve 104 containing U-tube 106; inlet/outlet port 108 which contains flow restrictor 110 and S-tube 112, the latter connecting also from inlet/outlet port 108 to the lower end (below piston 96) of cylinder 90; and finally solenoid 114. Hydraulic valve 102 is normally in a "closed" position (as shown in FIG. 6) in which sliding valve 104 is disposed so that the two arms of U-tube 106 do not coincide, respectively, with flow restrictor 110 and S-tube 112. That position of sliding valve 104 constitutes a "latched" condition of left and right shock absorber/latches 82*g*, 82*d*, i.e., because the flow of hydraulic fluid 94 in or out of the top and bottom of cylinder 90 is prevented.

In such a latched condition of hydraulic valve 102, it can be seen that left and right shock absorber/latches 82*g*, 82*d* can nevertheless change from an extended to a shortened condition, e.g., as in transforming from the condition of grapple 10 shown in FIG. 5B (points B of frames 16*g*, 16*d* point upwardly and shock absorber/latches 82*g*, 82*d*, if present in lieu of the left and right hydraulic shock absorbers 26*g*', 26*d*' actually shown in FIG. 5B, will be extended) to that shown in FIG. 5A (points B of frames 16*g*, 16*d* point outwardly and absorber/latches 82*g*, 82*d* are shortened). Such a movement, which will be brought about, e.g., by a slackening of cables 14*d*, 14*g* so that the weight of left and right flames 14*g*, 14*d* causes an upward force on rod 97 (in the perspective of FIG. 6), corresponds to an upward movement of piston 96 relative to cylinder 90 which is permitted by check valve 98 as just stated.

On the other hand, if solenoid 114 is activated by an electrical signal from a helicopter (electrical lines not shown), the upper and lower arms of U-tube 106 will become aligned respectively with flow restrictor 110 and S-tube 112; hydraulic fluid is allowed to flow leftwardly and upwardly through S-tube 112, around U-tube 106, and then rightwardly through flow restrictor 110 so as to move such fluid from the bottom part of cylinder 90 to the top, i.e., piston 96 is allowed to move downwardly within cylinder 90 so as to transform left and right shock absorber/latches 82*g*, 82*d* from a shortened into an extended configuration. Flow restrictor 110 acts to inhibit the rate of such flow, hence a shock absorber action is provided in this case as well.

In the course of using grapple 10, left and right shock absorber/latches 82*g*, 82*d* will again be latched to prevent the same from changing into an extended configuration at a time that a new load is to be grasped as previously described. Left and right shock absorber/latches 82*g*, 82*d* thus provide the advantages over left latch 50*g* of FIGS. 3A–3D (and of course a right latch 50*d* as well) that for greater flexibility of operation such unlatching or latching can be carried out at any position thereof, and secondly the device provides its own internal shock absorber effect as just stated.

Figure 7B:
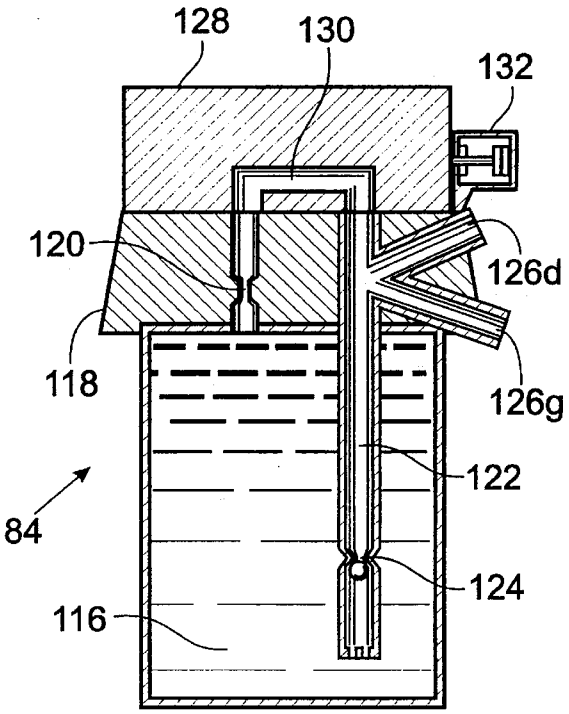
FIGS. 7A–7B show different aspects of the fluid control part of the shock absorber/latch of FIG. 5B.
Figure 7A:
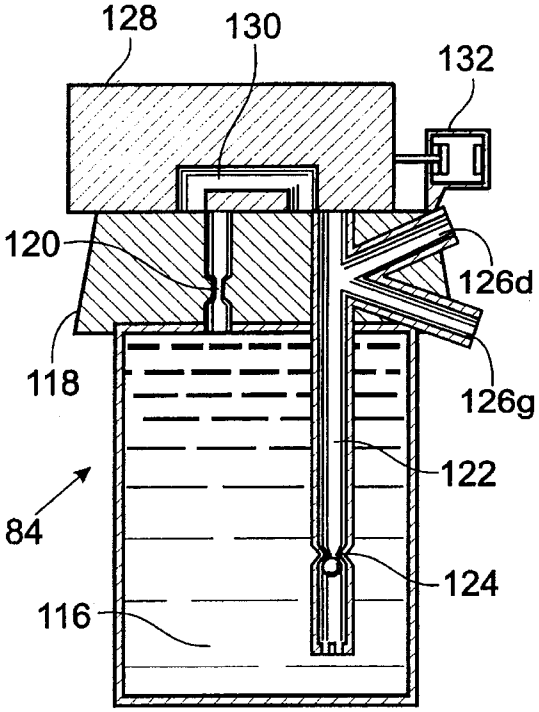

Hydraulic control 84 as depicted in FIG. 5B operates in a manner similar to that of hydraulic valve 102, is shown in greater detail in FIGS. 7A–7B, and comprises an oil tank 116, a fluid port 118 having a flow inhibitor 120 passing therethrough into the top of oil tank 116, and a tank port 122 also leading therethrough to near the bottom of oil tank 116, said tank port 122 having a check valve 124 therein. Also included in fluid port 118 is a pair of fluid outlets, i.e., left fluid outlet 126*g* which connects to left hydraulic hose 86*g*, and right fluid outlet 126d which connects to right hydraulic hose 86*d*, both of left and right hydraulic hoses 86*g*, 86*d* being shown in FIG. 5B. Atop (in the perspective of FIGS. 7A–7B) the aforesaid structure of hydraulic control 84 is a fluid controller 128 which includes U-outlet 130 and electrical solenoid 132.

In FIG. 7A, fluid controller 128 is shown in its ordinarily latched position for which fluid cannot flow either into or out of oil tank 116 therethrough. At such time, however, fluid can flow out of oil tank 116 by virtue of tank port 122 and check valve 124, the latter permitting outward flow therethrough (i.e., such outward flow corresponds to upward flow through check valve 124). Upon slackening cables 14*d* and 14*g* in FIG. 5B, therefore, frames 16*g* and 16*d* are allowed to fall downward, and-left and right hydraulic shock absorbers 26*g*', 26*d*' will shorten, thus drawing hydraulic fluid inwardly thereto. That fluid enters left and right hydraulic shock absorbers 26*g*', 26*d*' below pistons 88 thereof through left and right hydraulic hoses 86*g*, 86*d*, and excess air above pistons 88 is forced outwardly through left and right air hoses 87*g*, 87*d* into left and right arms 18*g*, 18*d*, respectively.

FIG. 7B shows the open configuration that is realized upon activation of solenoid 132 by a signal from a helicopter (electrical lines not shown). This configuration permits the raising again of frames 16*g*, 16*d* so as to pick up another load by permitting lengthening of left and right hydraulic shock absorbers 26*g*', 26*d*', i.e., by downward movement of pistons 88 therein, oil will flow outwardly therefrom through left and right hydraulic hoses 86*g*, 86*d* and then U-outlet 130 into tank 116.

The advantages of hydraulic control 84, left and right hydraulic hoses 86*g*, 86*d* and left and right hydraulic shock absorbers 26*g*', 26*d*' as compared to left and right shock absorber/latches 82*g*, 82*d* described earlier are that only one expensive hydraulic control device is required rather than two, the cylinder and piston structure can be simpler (no flow restrictors or check valves are included therein), and finally control of the single hydraulic control 84 serves to carry out the latching and unlatching of both sides of grapple 10 simultaneously.

Figure 8:
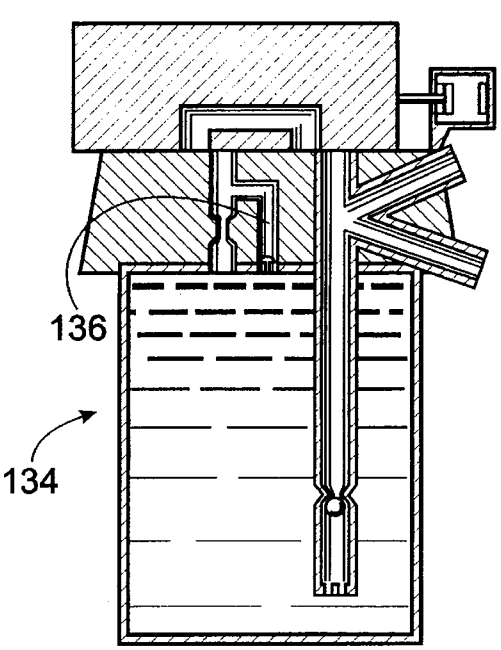
FIG. 8 shows an alternative shock absorber/latch that includes a pressure valve.

A variation of hydraulic control 84 is shown in FIG. 8 (in which repeated numerical references are deleted for clarity), wherein pressure controlled hydraulic control 134 is essentially identical in structure to hydraulic control 84 except as to including pressure sensitive device 136 connected from a side of flow inhibitor 120 downwardly to access oil tank 116. Pressure sensitive device 136 serves to allow fluid to flow into oil tank 116 quickly if the external forces (and hence the pressure on the contained hydraulic fluid) is low, i.e., when there is but a small load being held by grapple 10, but slows down such fluid flow when that pressure is high, i.e., a heavy load is being carried and there is greater danger of shock to the helicopter so that more shock absorber effect is required.

It will be understood by those of ordinary skill in the art that other arrangements and disposition of the aforesaid components, the descriptions of which are intended to be illustrative only and not limiting, may be made without departing from the spirit and scope of the invention. In particular, it would be obvious from the foregoing to consolidate various elements of the invention into a single embodiment, e.g., a spring may be used in connection with the hydraulic as well as the mechanically latching devices, and with the aforesaid shock absorber types that either are or are not hydraulic in nature. The invention must then be identified and determined only from the following claims and equivalents thereof.

We claim:

1. A grapple comprising:

a pair of arms rotatably connected near proximal ends thereof and having mutually facing concave surfaces;

a pair of elongate frames respectively rotatably attached at proximal ends thereof to each of said arms, the distal ends of said frames being attached to cables for lifting; and weight-activated latch means rotatably connected at opposite ends thereof between each said frame and the one of said arms to which said frame is rotatably attached, wherein said latch means further comprise shock absorber means.

2. A grapple comprising a pair of arms rotatably connected near proximal ends thereof and having mutually facing concave surfaces;

a pair of elongate frames respectively rotatably attached at proximal ends thereof to each of said arms, the distal ends of said frames being attached to cables for lifting; and weight-activated latch means rotatably connected at opposite ends thereof between each said frame and the one of said arms to which said frame is rotatably attached, wherein said latch means further comprise hydraulic means.

3. The grapple of claim 2 wherein said hydraulic means comprise:

an elongate cylinder containing a quantity of hydraulic fluid and having an attachment at a first end thereof;

a piston including a rod extending therefrom being disposed within said cylinder such that said rod extends outwardly from said cylinder through a second end thereof opposite said first end, said rod further comprising a connection on the distal end thereof; and a check valve disposed within said cylinder so as to permit movement of said piston through said hydraulic fluid in a first direction therethrough, but to preclude such movement in a direction opposite said first direction.

4. The grapple of claim 3 further comprising shock absorber means, wherein said check valve is disposed within said piston so as to permit movement of hydraulic fluid through the plane of said piston in a direction opposite said first direction, said check valve further being of a size to retard said movement of hydraulic fluid sufficiently to provide absorption of an applied shock.

5. The grapple of claim 2 wherein said hydraulic means further comprise hydraulic control means attached to and controlling each of said hydraulic means.

6. The grapple of claim 5 wherein said hydraulic control means comprise:

an inlet/outlet port including therein a flow restrictor connecting on a first side thereof to the interior of said cylinder on a side of said piston opposite said rod, and an S-tube connecting on a first side thereof to the interior of said cylinder near to said second end thereof, on the same side of said piston as said rod;

a sliding valve attached to said inlet/outlet port and including therein a U-tube having extensions disposed towards said inlet/outlet port such that in a first position thereof said extensions are displaced from respective second ends of said flow restrictor and said S-tube, whereas in a second position thereof said extensions are disposed in hydraulic connection with respective second ends of said flow restrictor and said S-tube, thereby permitting flow of hydraulic fluid between said flow restrictor and said S-tube through said U-tube; and solenoid means for moving said sliding valve between said first and second positions thereof.

* * * * *